US006918601B2

(12) United States Patent
Sauter et al.

(10) Patent No.: US 6,918,601 B2
(45) Date of Patent: Jul. 19, 2005

(54) TOOL-LESS SIZE-ADJUSTABLE IN-LINE SKATE

(75) Inventors: Thomas M. Sauter, Seattle, WA (US); Darrin John Haugen, Seattle, WA (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 09/861,189

(22) Filed: May 18, 2001

(65) Prior Publication Data

US 2002/0171210 A1 Nov. 21, 2002

(51) Int. Cl.[7] ..... A63C 1/26

(52) U.S. Cl. ..... 280/11.26; 280/11.231; 280/11.27

(58) Field of Search ..... 280/11.26, 11.27, 280/11.3, 11.31, 11.221, 11.231, 11.16; 36/97, 115

(56) References Cited

U.S. PATENT DOCUMENTS

| | | | | | |
|---|---|---|---|---|---|
| 311,077 | A | | 1/1885 | Kitselman | |
| 916,289 | A | | 3/1909 | Fitzgerald | |
| 2,572,050 | A | | 10/1951 | Ornstein | |
| 2,734,284 | A | | 2/1956 | Seurbom | |
| 3,086,787 | A | | 4/1963 | Wyche | |
| 3,997,985 | A | | 12/1976 | Shiina | |
| 5,184,834 | A | | 2/1993 | Yu | |
| 5,314,199 | A | | 5/1994 | Olson et al. | |
| 5,484,149 | A | * | 1/1996 | Lee | 280/11.26 |
| 5,513,861 | A | | 5/1996 | Monroy et al. | |
| 5,513,863 | A | | 5/1996 | Klamer et al. | |
| 5,645,288 | A | | 7/1997 | Lu | |
| 6,045,144 | A | * | 4/2000 | Wong | 280/11.26 |
| 6,217,039 | B1 | * | 4/2001 | Iveerson et al. | 280/11.26 |
| 6,247,707 | B1 | * | 6/2001 | Conte | 280/11.26 |
| 6,276,697 | B1 | * | 8/2001 | Lin | 280/11.26 |
| 6,308,965 | B1 | * | 10/2001 | Yang | 280/11.26 |
| 6,450,510 | B1 | * | 9/2002 | Liu | 280/11.26 |
| 6,547,261 | B2 | * | 4/2003 | Gorza et al. | 280/11.223 |
| 6,612,592 | B1 | * | 9/2003 | Soo | 280/11.16 |
| 6,669,210 | B2 | * | 12/2003 | Chen | 280/11.16 |

FOREIGN PATENT DOCUMENTS

| | | |
|---|---|---|
| DE | 174665 | 8/1905 |

* cited by examiner

*Primary Examiner*—Christopher P. Ellis
*Assistant Examiner*—Jeff Restifo
(74) *Attorney, Agent, or Firm*—Christensen O'Connor Johnson Kindness PLLC

(57) ABSTRACT

A size-adjustable in-line skate having a base carrying a plurality of wheels thereon. An upper is secured to a top surface of the base and defines a heel portion, a toe portion, and diametrically opposed side wall portions. The upper is supported by a support structure that includes a heel cup and a toe cup. The toe cup is secured to the toe portion of the upper and slideably coupled to the base so that the toe cup can slide longitudinally with respect to the base. An actuator is coupled to the toe cup and travels therewith. When the actuator is translated, engagement members on the actuator disengage with detents on the base to allow the toe cup to freely slide between longitudinal positions to adjust the shoe size of the skate.

27 Claims, 10 Drawing Sheets

TOOL-LESS SIZE-ADJUSTABLE IN-LINE SKATE

FIELD OF THE INVENTION

The present invention relates to skates such as in-line skates, and in particular to an in-line skate having a tool-less size adjustment mechanism for adjusting the shoe size of the skate.

BACKGROUND OF THE INVENTION

In recent years, the sport of roller skating, and in particular in-line roller skating, has enjoyed a tremendous growth in popularity. Generally described, conventional in-line roller skates include an upper boot secured to or integrally formed with a rigid or semi rigid base. The base, in turn, is secured along its length, including at heel and toe ends, to a rigid frame. A plurality of wheels are journaled transversely along a longitudinal axis between the side walls of the frame.

One segment of the population that has enjoyed the sport of roller skating is children. The costs associated with the sport can be limiting for parents. With the new developments in features and the advancements in materials, high quality in-line skates can be expensive. This expense is compounded when buying in-line skates for children because as a child grows, their foot size expands necessitating frequent replacement of the in-line skates.

To address this problem, several skates have been proposed that are size adjustable to accommodate the feet of growing users. One such skate is disclosed in U.S. Pat. No. 5,913,526. The in-line skate includes a skate boot secured to a frame and contains a liner. The frame carries a plurality of wheels. The skate boot includes a heel portion, a cuff, a tongue, and a toe portion. The toe portion is selectively connected to the frame via a bolt, which is received by a nut. The bottom wall of the toe portion includes an elongate slot extending in the longitudinal dimension of the skate through which the bolt passes. When assembled with the heel portion, the toe portion may move along a line of travel which is generally parallel to the longitudinal dimension of the skate by loosening the nut. This configuration requires a tool, inserted upwardly between the wheels, to adjust the size of the skate, which is inconvenient. Repeated adjustment may lead to stripping of the nut, thus limiting the skate's ability to adjust. During adjustment, the bolt and/or nut may be lost.

SUMMARY OF THE INVENTION

The present invention overcomes the deficiencies in the prior art by providing a size-adjustable skate having at least one ground engaging member which comprises a base having a top surface for supporting a skater's foot. The base defines a plurality of detents. An upper for receiving a skater's foot is coupled to the base and includes a toe portion, a heel portion, and diametrically opposed side wall portions. The skate also includes a support structure for supporting the upper. The support structure includes a toe member having top and bottom surfaces and coupled to the toe portion of the upper and slideably coupled to the base. The toe member is slideably adjustable between a plurality of longitudinal positions on the base and has an actuator coupled thereto. The actuator is operable to move in a plane coplaner with the top surface of the base. The toe member is selectively slideable on the base to adjust the shoe size of the skate.

In an embodiment, the toe member is selectively slideably on the base to adjust the shoe size of the skate by operation of a size adjustment mechanism formed between the detents of the base and a portion of the actuator.

In accordance with another aspect of the present invention, an size-adjustable skate having at least one ground engaging member is provided which comprises a base having a top surface for supporting a skater's foot, and a bottom surface. The base defines a plurality of detents. An upper for receiving a skater's foot is coupled to the base and includes a toe portion, a heel portion, and diametrically opposed side wall portions. The skate also includes a support structure for supporting the upper. The support structure includes a toe member coupled to the toe portion of the upper and slideably coupled to the base. The toe member is slideably adjustable between a plurality of longitudinal positions. The skate further includes an actuator that is coupled to the toe member and translatable with the toe cup. The actuator is operable to fix the toe cup to the base in a desired longitudinal position relative to the heel portion and is operable to adjust the toe member so that the toe member slides longitudinally to achieve a second desired longitudinal position relative to the heel portion.

In accordance with yet another aspect of the present invention, a size-adjustable skate having at least one ground engaging member is provided which comprises a base having a top surface for supporting a skater's foot and a bottom surface. A frame is coupled to the bottom surface of the base and includes an aperture positioned between ground engaging members. An upper is coupled to the base for receiving a skater's foot and defines a toe portion, a heel portion, and diametrically opposed side wall portions. An elongate member is coupled to the bottom surface of the toe cup and translatable within the slot. The skate also includes a second elongate member cantilevered to the elongate member and extending through the aperture, the second elongate member including a first engagement member. A second engagement member having a plurality of detents is coupled to the base. The first engagement member engages the one of the plurality of detents to fix the toe cup to the base in a desired longitudinal position relative to the heel portion and the first engagement member disengaging with the one of the plurality of the detents to slideably adjust the toe cup in a longitudinal dimension relative to the heel portion.

In accordance with still yet another aspect of the present invention, an size-adjustable skate having at least one ground engaging member is provided which comprises a base having a top surface for supporting a skater's foot, and a bottom surface. The base defines a plurality of detents. An upper for receiving a skater's foot is coupled to the base and includes a toe portion, a heel portion, and diametrically opposed side wall portions. The skate also includes a support structure for supporting the upper. The support structure includes a toe member coupled to the toe portion of the upper and slideably coupled to the base. The toe member is selectively adjustable between a plurality of longitudinal positions. The skate further includes an actuator that is operably coupled in a horizontal plane to the toe member and slideable with the toe member. The actuator is selectively operable to engage with a portion of the base to fix the toe cup in a desired longitudinal position, and is operable to disengage with a portion of the base to allow the toe cup to slideably translate on the base to a second desired longitudinal position. The actuator is further operable to move in a plane substantially coplaner with the toe surface of the base.

In accordance with still yet another aspect of the present invention, an size adjustable skate having at least one ground engaging member is provided which comprises a base having a top surface for supporting a skater's foot, and a bottom surface. The base defines a plurality of detents. An upper for receiving a skater's foot is coupled to the base and includes a toe portion, a heel portion, and diametrically opposed side wall portions. The side wall portions defining a vamp opening extending upwardly from the toe portion of the upper. The upper further including a tongue disposed within the upper and having a lower end fastened to the toe portion of the upper and extending upwardly along the vamp opening, and an elastic web fastened to the upper on the diametrically opposed side wall portions and spanning across at least a portion of the vamp opening over the instep of the skater's foot, compressing the tongue under the vamp portion. The skate also includes a support structure for supporting the upper. The support structure includes a toe member coupled to the toe portion of the upper and slideably coupled to the base. The toe member is selectively adjustable between a plurality of longitudinal positions. The skate further includes an actuator that is operably coupled in a horizontal plane to the toe member and slideable with the toe member. The actuator is selectively operable to engage with a portion of the base to fix the toe cup in a desired longitudinal position, and is operable to disengage with a portion of the base to allow the toe cup to slideably translate on the base to a second desired longitudinal position. The actuator is further operable to move in a plane substantially coplaner with the toe surface of the base.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
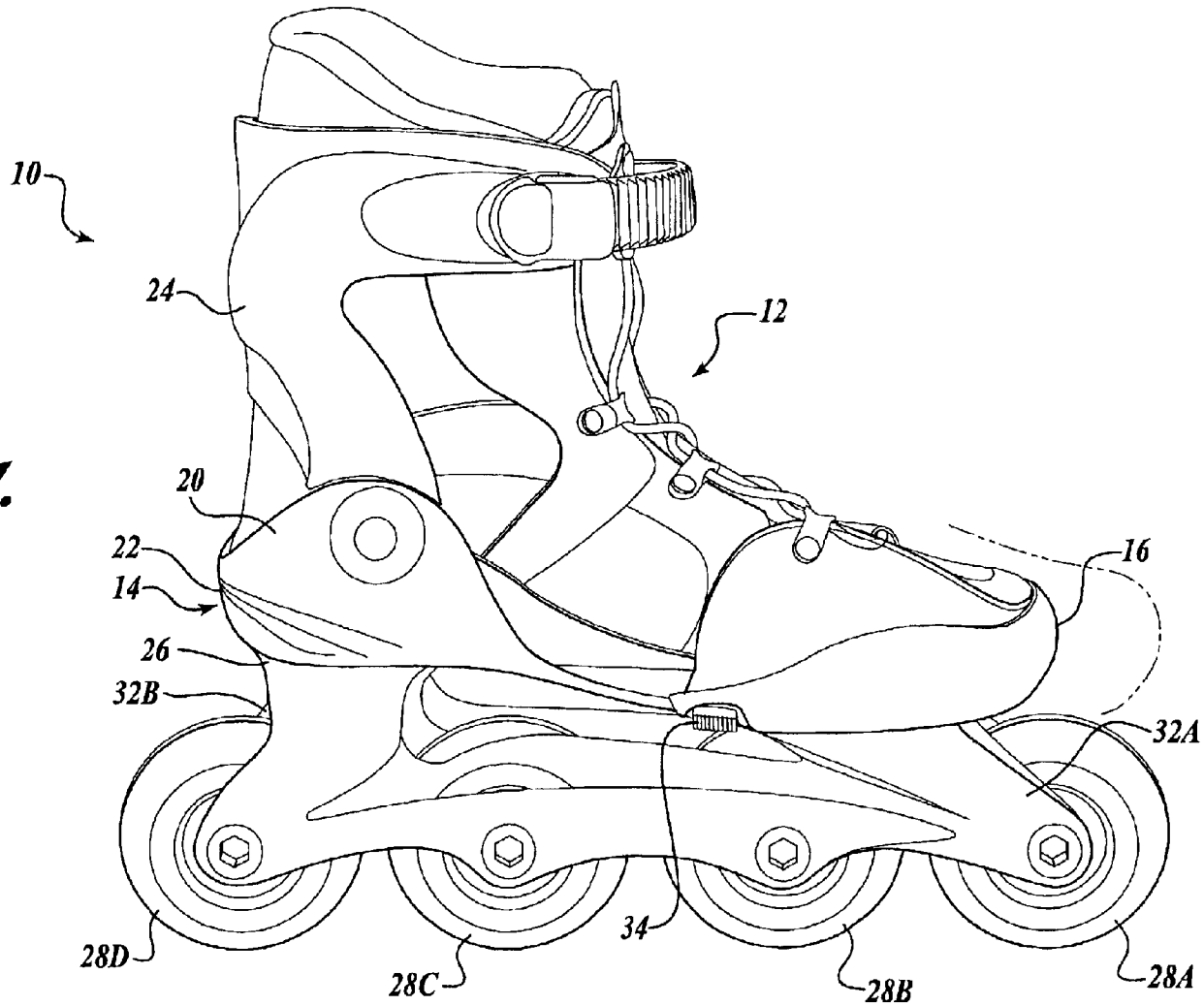
FIG. 1 illustrates an isometric view of a tool-less size-adjustable in-line skate constructed in accordance with aspects of the present invention.

The present invention will now be described with reference to the accompanying drawings where like numerals correspond to like elements. A suitable embodiment of a tool-less size-adjustable in-line skate 10 constructed in accordance with the present invention is illustrated in FIG. 1. The skate 10 includes a substantially non-rigid upper 12 that receives and surrounds a skater's foot and ankle. The upper 12 is mounted on and secured to the upper surface of a base 14. The upper 12 is supported by a substantially rigid external support, including a slideably adjustable toe cup 16 extending upwardly from the toe end 18 of the base 14, a heel cup 20 extending upwardly from the heel end 22 of the base 14, and an ankle cuff 24 pivotally secured to the base 14. The base 14 is mounted to or integrally formed with a frame 26, which extends longitudinally beneath the base 14. A plurality of ground engaging members such as wheels 28A, 28B, 28C, and 28D are journaled between first and second opposing longitudinal side walls 32A and 32B of the frame 26. The toe cup 16 includes an actuator 34 such as a push-button which can be depressed or translated so that the slideably adjustable toe cup 16 may slide along the longitudinal axis of the skate to adjust the shoe size of the skate 10.

Suitable materials and construction (except for adjustable aspects) for the non-rigid upper 12 and substantially rigid outer support are disclosed in U.S. Pat. No. B1 5,437,466, hereby expressly incorporated by reference. Alternatively, an internal support structure can be used with the non-rigid upper, as described in U.S. Pat. No. 6,168,172, hereby expressly incorporated by reference. Further, various components of the non-rigid portions of the support can be modified for a higher degree of rigidity.

Figure 2:
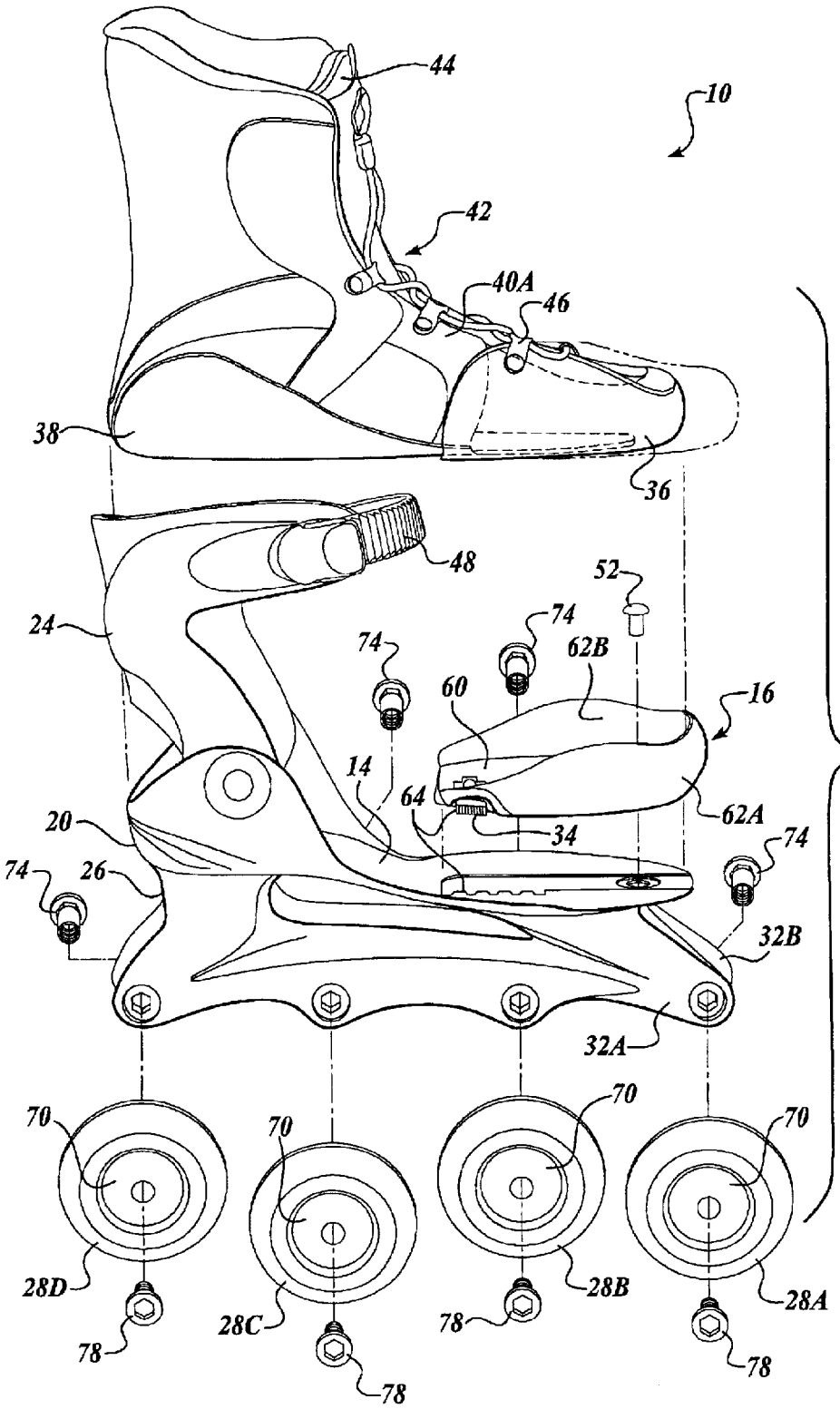
FIG. 2 illustrates a side assembly view of the skate shown in FIG. 1.

Referring to the illustrative embodiment of FIG. 2, the upper 12 includes a toe end 36, a heel end 38, and diametrically opposed sides 40A and 40B which define a vamp opening 42. The toe end 36 is separate from the rest of the upper 12 and when assembled, overlaps with the sides 40A and 40B. A tongue 44 is fastened to the upper 12, extending upwardly beneath the vamp opening 42. The vamp opening 42 is drawn closed and the soft upper is fitted and drawn about the skater's foot by a lacing system 46. Alternate constructions that do not use a lacing system are within the scope of the invention and will be described below. An ankle cuff strap 48, connected to the ankle cuff 24, may be selectively secured to fasten the cuff 24 about the skater's lower leg, above the ankle cuff 24. The upper 12 may include other components such as a sole or the like.

Figure 13:
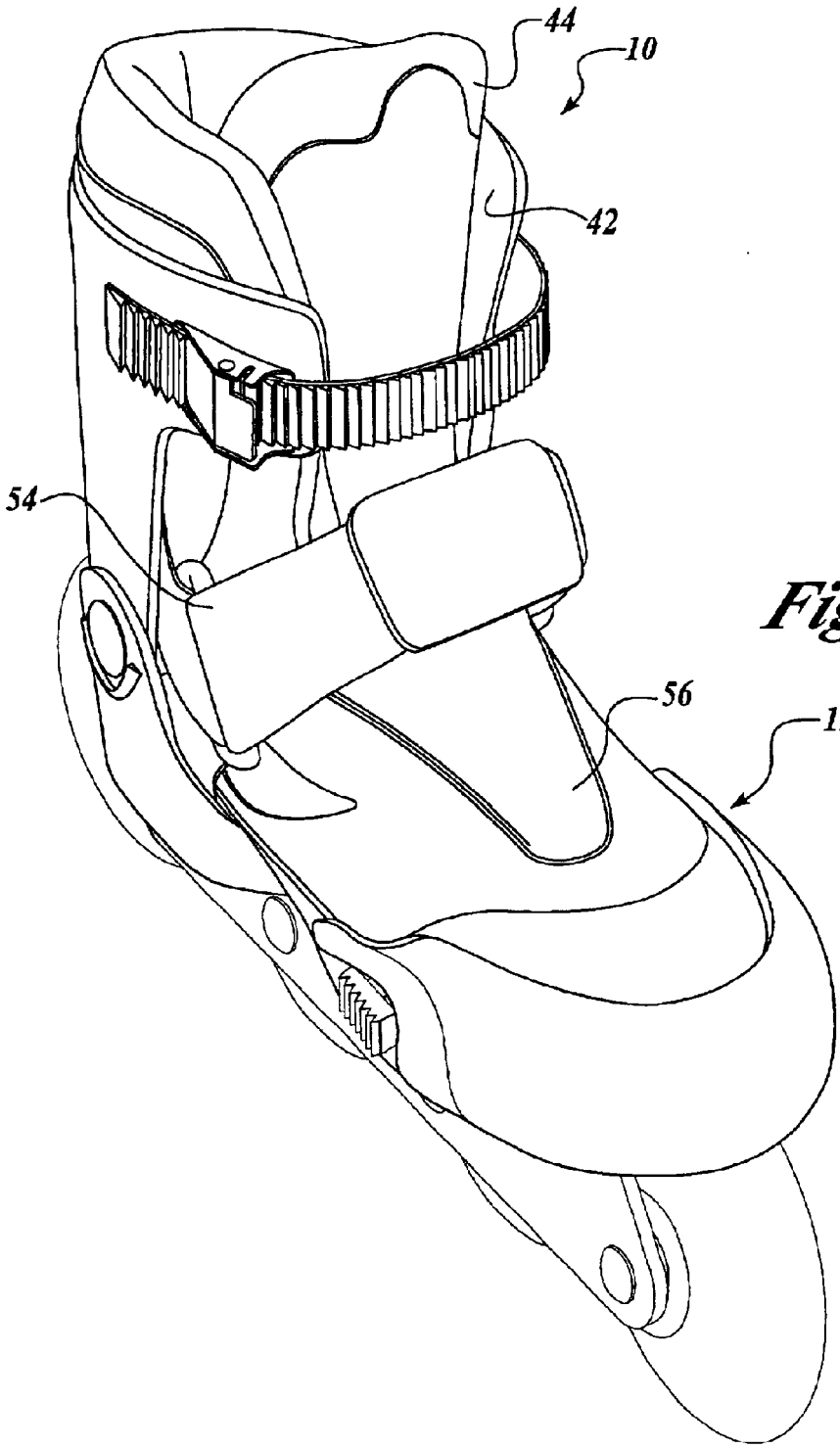
FIG. 13 illustrates an isometric view of another embodiment of a tool-less size-adjustable in-line skate constructed in accordance with aspects of the present invention.

As shown in FIG. 13 and briefly discussed above the upper 12 may be drawn closed by an alternative closure system to securely couple the upper to a rider's foot. In the alternative closure system, the vamp opening 42 of the upper 12 of skate 10 may be drawn closed by an elastic web 54 which extends across a lower portion of the vamp opening 42, overlying the tongue 44. The closure system of the skate may further includes an instep strap 56 secured across the upper 12, extending from a lateral side of the heel cup to a medial side of the heel cup, below the ankle. A more detailed description of the alternative closure system utilizing an elastic web, is found in co-pending U.S. application Ser. No. 09/847,959, entitled FAST ENTRY ELASTIC VAMP CLOSURE SKATE to Bennett, and filed May. 2, 2001, the disclosure of which is hereby incorporated by reference.

Referring to FIG. 2, the skate 10 will now be described in more detail. The upper 12 of the skate 10 is constructed of a majority of substantially non-rigid materials, and is supported by a rigid or at least semi-rigid external support. The substantially non-rigid upper 12 is suitably constructed from flexible materials such as fabric, leather, flexible plastics, and cushioning materials such as fiber fleece, batting or elastomeric foams. The toe end 36 of the upper 12 is securely fastened to the toe cup 16, such as by riveting, stitching, bolts or the like. The toe cup 16 includes a bottom wall 60 and medial and lateral side walls 62A and 62B that extend upwardly around the toe end 36 of the upper 12. The toe cup 16 is slideably coupled to the toe end 18 of the base 14 with a fastener 52, such as a rivet, bolt, screw or the like, that will be described in more detail below. The toe cup 16 includes an actuator 34 operatively connected within the medial side wall 62A and is a part of a size adjustment mechanism 64 for adjusting the shoe size of the skate. The actuator 34 and the size adjustment mechanism 64 will be described in more detail below.

The heel end 38 of upper 12 is securely fastened to the base 14, such as by riveting, adhesion, stitching, bolts or the like, and is supported by a rigid heel cup 20. The rigid heel cup 20 may be integrally formed with the base 14, or secured to the base 14, and extends upwardly therefrom on the lateral and medial sides of the heel end 38 of the upper 12. The ankle cuff 24 is pivotally secured to the upper lateral and medial ends of the heel cup 20, to pivot forwardly and rearwardly at about the natural pivot axis of the ankle. The ankle cuff 24 wraps the rear, lateral and medial sides of the leg, above the ankle. The ankle cuff strap 48 includes a quick release ratcheting buckle assembly to selectively secure and tighten the cuff about the leg.

The upper 12 of the skate 10 extends continuously upward from the base to above the upper edge of the ankle cuff 24. However, it should be apparent that the present invention is also suitably used with skates having an upper that is discontinuous, having a separate cuff pad, or that terminates below the ankle.

Still referring to FIG. 2, the frame 26 is mounted below or integrally formed with the base 14, and extends downwardly from the base 14. The frame 26 includes first and second opposing longitudinal side walls 32A and 32B. The frame 26 carries four wheels, 28A, 28B, 28C, and 28D, journaled between the opposing side walls 32A and 32B. Each wheel includes a center hub 70 and bearing assembly (not shown) that is mounted rotatably on an axle 74 that is inserted through aligned apertures 76 of the side walls 32A and 32B and is retained by cap screws 78. The frame 26 can be formed from any suitable rigid material, such as aluminum, titanium, other metals and alloys, engineering thermoplastics, and fiber reinforced thermoplastics or thermosetting polymers. An optional brake member may be fastened to the frame, rearward of the wheel 28D, which is well known in the art.

Figure 4:
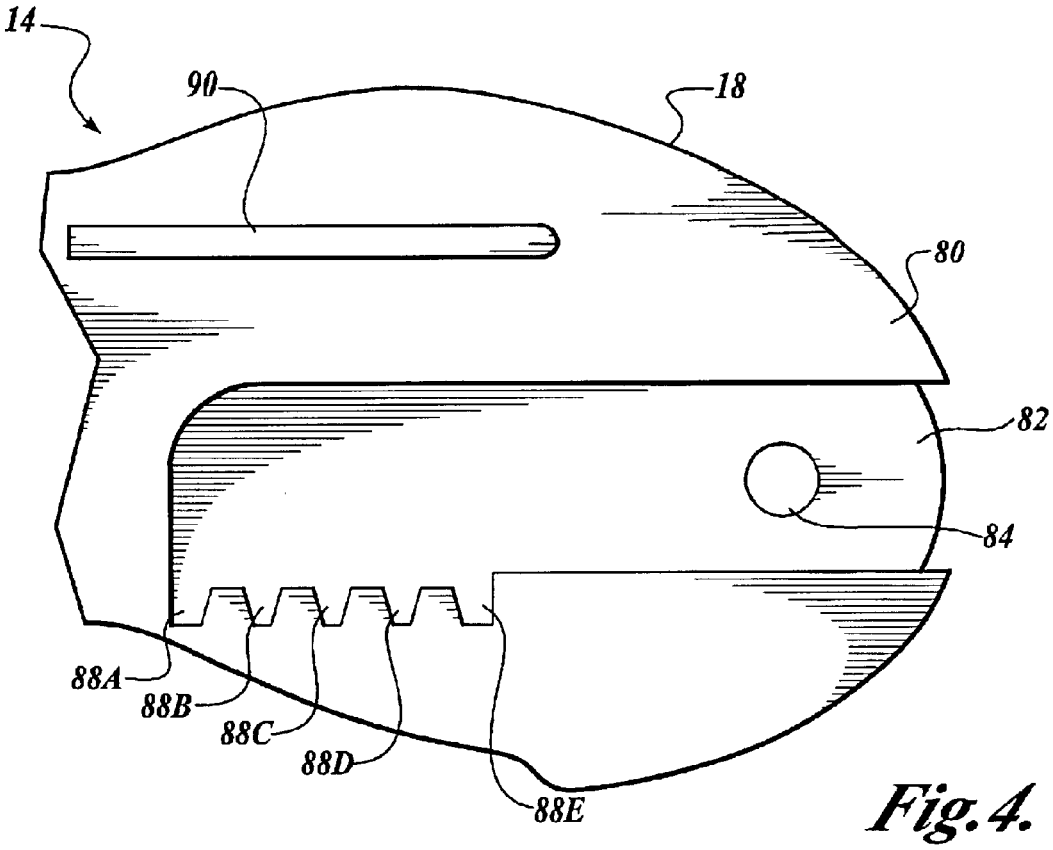
FIG. 4 illustrates a top view of the toe end of the base shown in FIG. 2.

In accordance with an aspect of the present invention, the skate 10 includes a size adjustment mechanism 64 having an actuator 34 for adjusting the shoe size of the skate 10, which was briefly discussed above and will now be described in greater detail with reference to FIGS. 4–9. As shown in FIG. 4, the toe end 18 of the base 14 extends as a generally oval shaped member having a substantially flat top surface 80 suitably sized for supporting the slideably adjustable toe cup. The toe end 18 includes an elongate, generally rectangular recess or slot 82 open to the top surface thereof, and extending in the longitudinal dimension of the skate for receiving a boss of corresponding shape located at the bottom surface of the toe cup. The slot 82 includes an aperture 84 on the bottom surface of the slot 82, and is positioned at the forward portion of the slot 82 and extends through the base 14. The aperture 84 is of a suitable shape and size to receive a fastener such as rivet 52 (FIG. 2) to securely couple the toe cup to the base 14.

Positioned at the rear portion of the slot 82 and formed into the medial side thereof is a series of detent notches 88A, 88B, 88C, 88D, and 88E. In one embodiment, the detent notches form teeth that are frusto-conical in shape and protrude horizontally inward toward the centerline of the slot 82. While shown in FIG. 4 as frusto-conical in shape, the detent notches can be of any suitable size or geometry without departing from the scope of the present invention. The detent notches 88A, 88B, 88C, 88D, and 88E are operable to engage or mesh with correspondingly shaped teeth on the actuator to form the indexing size adjustment mechanism, the operation of which will be described in more detail below. In the embodiment shown, five detent notches are formed in the base. However, it will be appreciated that any number of detent notches may be formed in the base. The top surface 80 of the toe end 18 further includes an elongate rib member 90 that extends substantially parallel with the slot 82. The elongate rib member 90 mates with and slides within a slot of corresponding shape within the bottom wall of the toe cup to provide a guide mechanism that prevents rotation of the toe cup as it slideably translates on the toe end 18.

Figure 5:
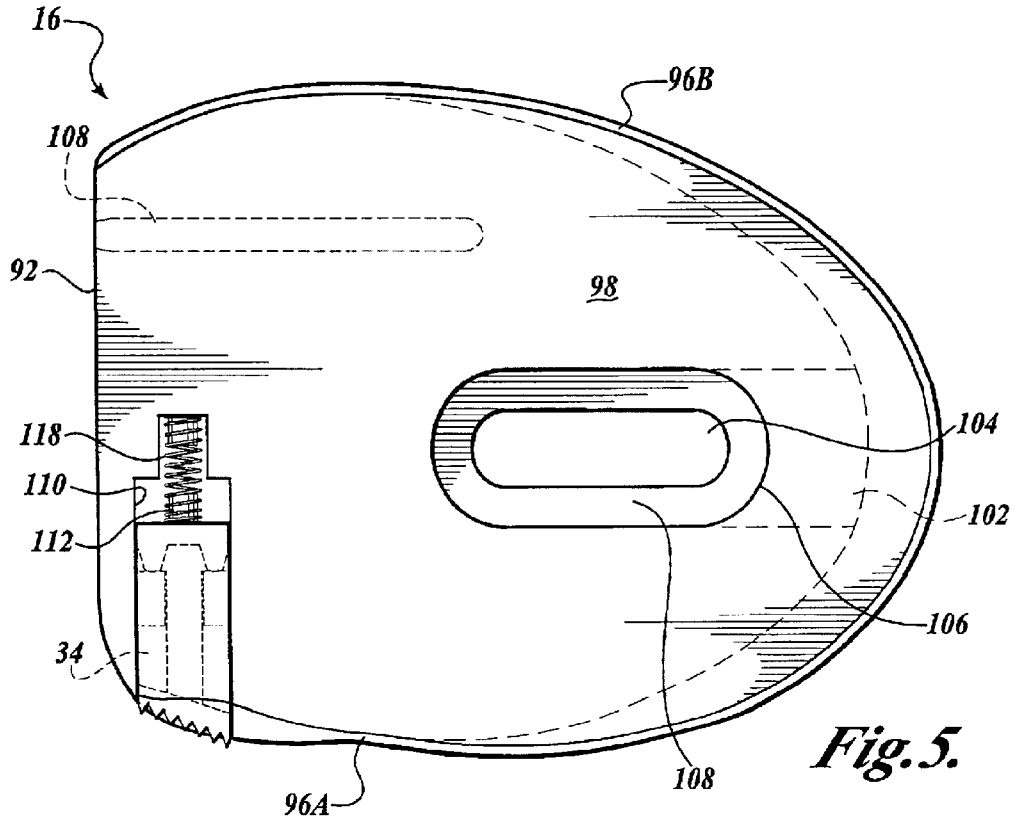
FIG. 5 illustrates a top view of the toe cup shown in FIG. 2.
Figure 6:
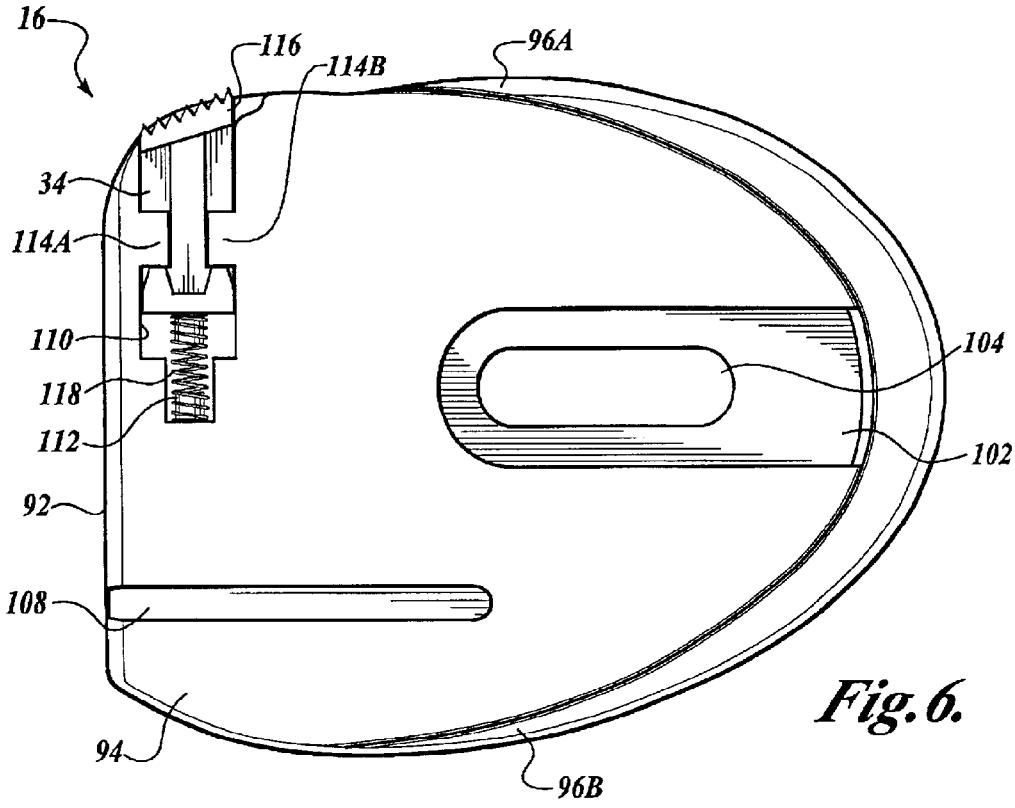
FIG. 6 illustrates a bottom view of the toe cup shown in FIG. 2.

Referring now to FIGS. 5 and 6, the toe cup 16 includes a bottom wall 92 having a substantially flat bottom surface 94 for slideably engaging with the top surface of the base. The toe cup 16 also includes medial and lateral side walls 96A and 96B that extend upwardly from the bottom wall 92 to form a cavity 98. The cavity 98 is of a suitable dimension to receive the forefoot of a skater. While shown as a toe cup, it will be appreciated that the slideable support member can be a toe member such as a substantially flat plate or bottom wall 92. In either case, the bottom wall 92 of the toe cup 16 includes a longitudinally disposed slot 109 open to the bottom surface 94 for mating with the elongate rib member of the base described above. Extending downwardly from the bottom surface 94 of the toe cup 16 is a generally rectangular shaped boss 102 with rounded edges. The boss 102 extends lengthwise in the longitudinal dimension of the skate and is suitably shaped and positioned at the forward end of the bottom surface 94 to be slideably received within the slot 82 of the base 14 (FIG. 4). The boss 102 and corresponding slot of the toe end form a guide mechanism which, along with the guide mechanism described above comprised of the slot 108 and the elongate rib member, prevents rotation of the toe cup as it slideably translates on the toe end of the base.

The boss 102 is provided with an elongated slot 104 open to the bottom surface and also extending in the longitudinal dimension of the skate for passing a fastener such as rivet 52 when the toe cup 16 is slideably translated with respect to the base. As best shown in FIG. 5, the top surface of the bottom wall 92 includes an elongate slot 106 formed by downwardly descending side walls of the boss that is concentric with slot 104. The slot 106 is similar in shape, but larger in size, than slot 104 to form a shoulder 109 for supporting the head of the fastener 52 as the slots 104 and 106 pass the fastener when the toe cup 16 is slideably translated with respect to the base. The fastener 52 can be removable such as a bolt or screw, or can be nonremovable or permanent such as a rivet. In either case, the fastener 52 securely retains the toe cup on the base during adjustment.

Still referring to FIGS. 5 and 6, the bottom wall 92 includes a horizontally disposed slot 110, which is transverse to the longitudinally dimension of the skate. The slot 110 is suitably dimensioned to receive the actuator 34 of the size adjustment mechanism in a slideable fashion. The slot 110 also includes a tab portion 112 integrally formed at its innermost surface for receiving a biasing member 118 such as a spring. Integrally formed in the bottom wall 92 are two diametrically opposed tabs 114A and 114B for supporting the actuator as it slides horizontally within the slot 110. The rear portion of the medial side wall 96A includes an aperture 116 for allowing a portion of the actuator to protrude through the medial side wall 96A. When assembled, the toe cup 16 includes a cover plate or liner that over lays the top surface of the toe cup to prevent the actuator from falling out of the slot and to prevent adhesive, fabric, etc. from interfering with the sliding operation of the actuator.

Figure 3:
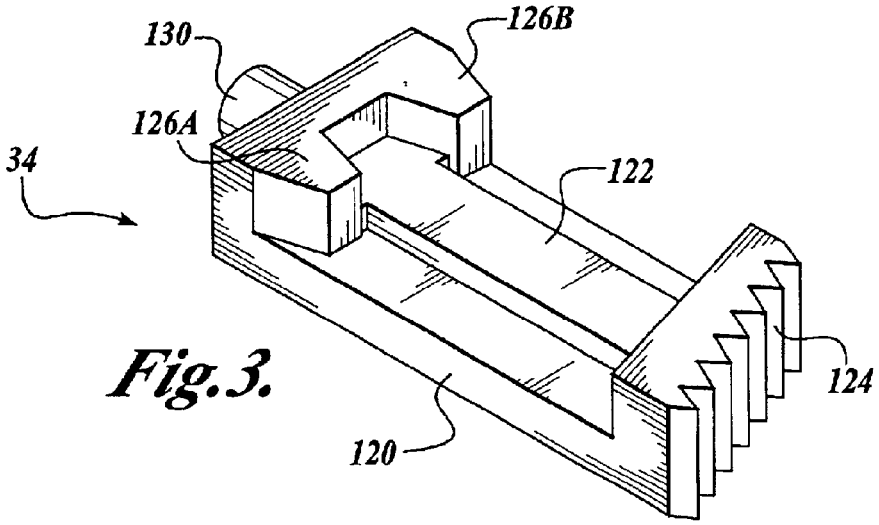
FIG. 3 illustrates an isometric view of the actuator shown in FIG. 2.

Referring now to FIG. 3, the actuator 34 of the size adjustment mechanism will be described in more detail. The actuator 34 is constructed as a unitary body having a generally T-shaped cross section. The actuator includes an upper member 120 and a lower member 122 extending transversely from the upper member 120 to form the T-shaped actuator. At one end, the actuator 34 includes a generally triangular shaped face 124 preferably grooved and suitably sized for engagement with the thumb or forefinger of a rider. The upper member 120 of the actuator 34 is substantially flat to slideably seat within the slot, flush with the top surface of the toe cup. The lower member 122 extends from the upper member 120 in a downward direction between the diametrically opposed tabs, which supports the actuator 34 and guides the horizontal translation of the actuator 34. Integrally formed from the upper member 122 at the end opposite of the face 120 are engagement members or teeth 126A and 126B. In one embodiment, the teeth are frusto-conical in geometry and face toward the face 120 of the actuator 34. While shown in FIG. 3 as generally frusto-conical in shape, the teeth 126A and 126B can be of any suitable size or geometry without departing from the scope of the present invention. It will be appreciated that the size and geometry of the teeth will correspond to the size and geometry of the detent notches so that the teeth may properly mesh with the detent notches. When slideably received in the slot of the base, the teeth 126A and 126B are disposed substantially horizontal and outwardly facing. The actuator 34 also includes a tab 130 connected to the rear end surface of the actuator for receiving one end of the biasing member 118 (FIGS. 5 and 6). The biasing member 118 biases the actuator 34 outward toward the medial side wall of the toe cup so that the teeth 126A and 126B mesh with the detent notches of the base.

Figure 7:
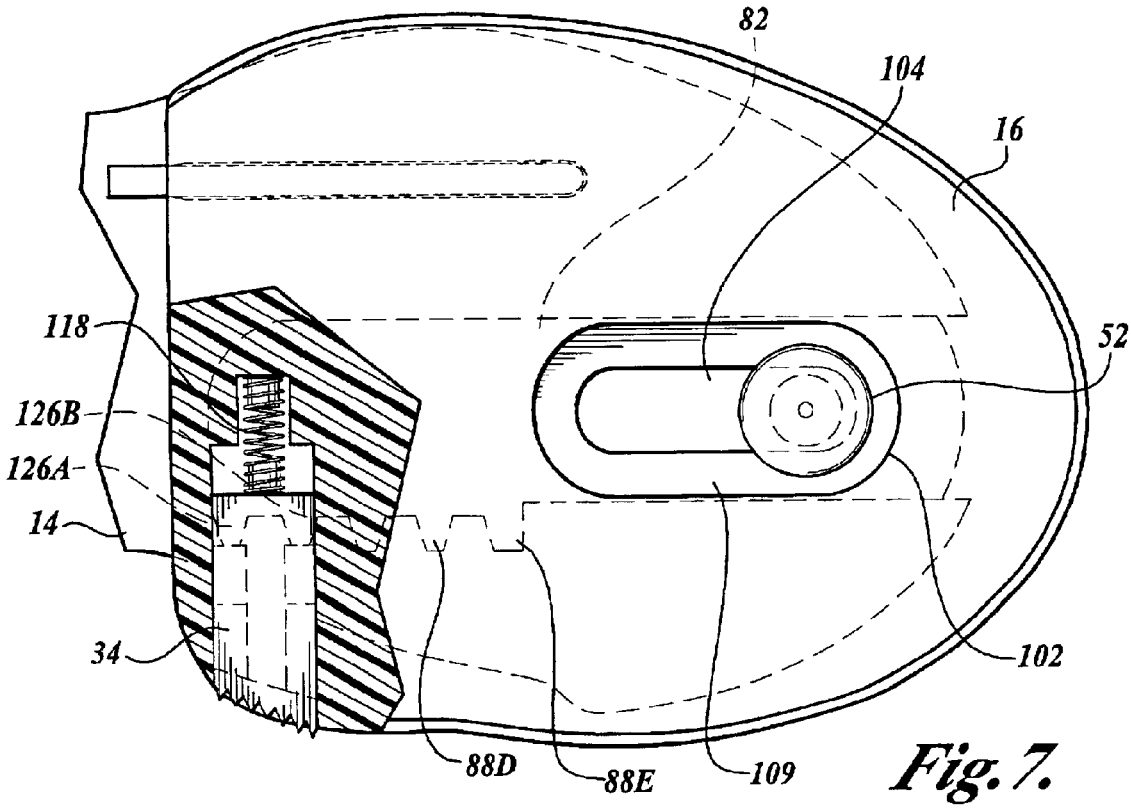
FIG. 7 illustrates a top cut-away view of the toe cup slideably mounted to the base in a fixed position.

The operation of the size adjustment mechanism will now be described in detail with reference to FIGS. 7 and 8. FIG. 7 depicts the toe cup 16 fixed at a desired longitudinal position relative to the heel end of the base (not shown). The toe cup 16 is supported by the top surface of the base 14, whereby the boss 102 is nested within the elongate slot 82 of the base 14. The toe cup 16 is securely fastened to the base 14 via the fastener 52, which is slideably received within the slot 104 with the head portion of the fastener 52 supported by the shoulder 108. The actuator 34 is biased by the biasing member 18 outward such that the teeth 126A and 126B located on the bottom of the actuator 34 mesh with two of the detent notches 88A–E formed within the slot 82 (FIG. 7 shows teeth 126 and 126 meshing with detent nothing 88 and 88B). In this position, a skater may skate without the toe cup sliding relative to the base.

Figure 8:
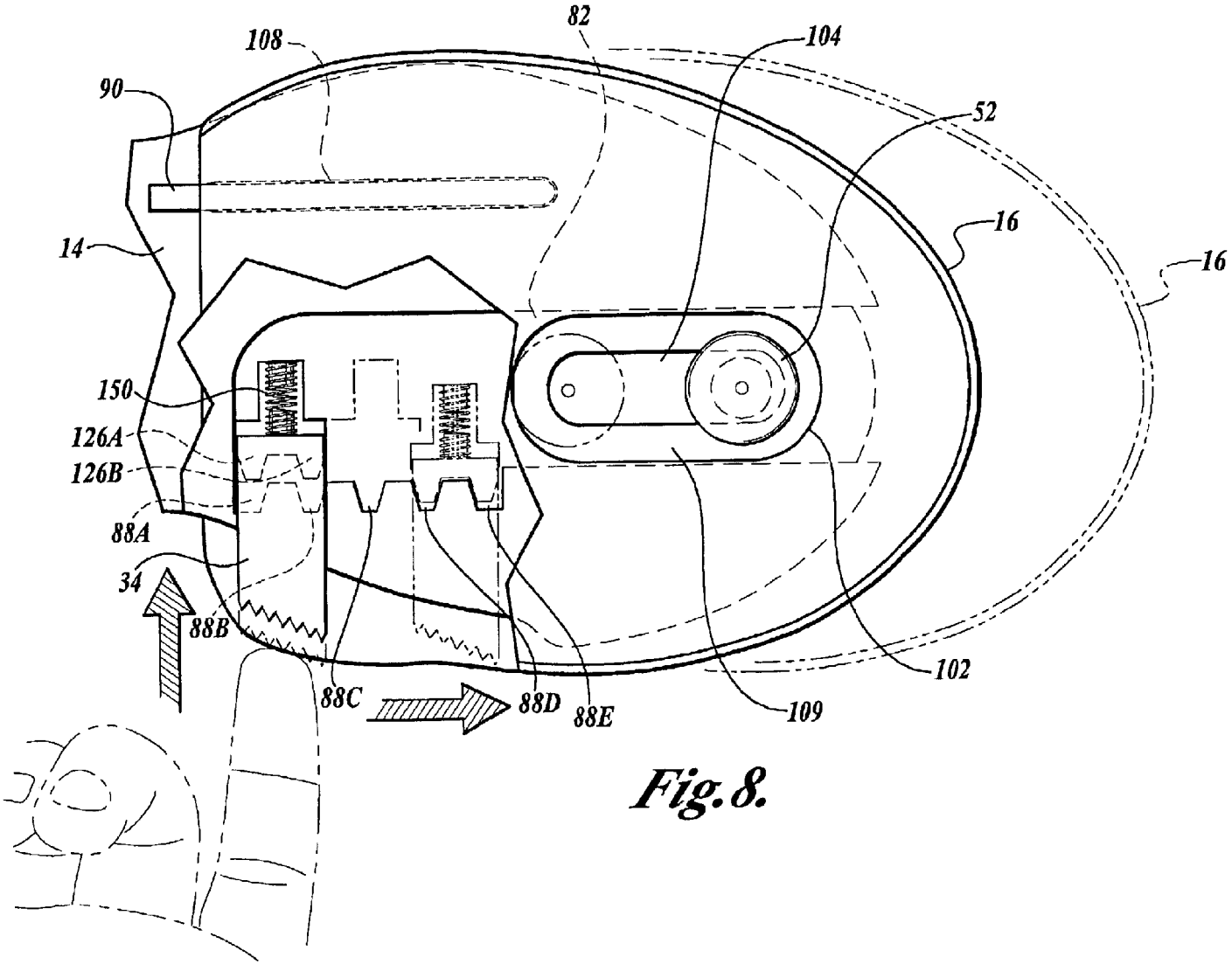
FIG. 8 illustrates a to cut-away view of the actuator being depressed and disengaged with the detents, and the toe cup translated in the longitudinal dimension to a second position.
Figure 10:
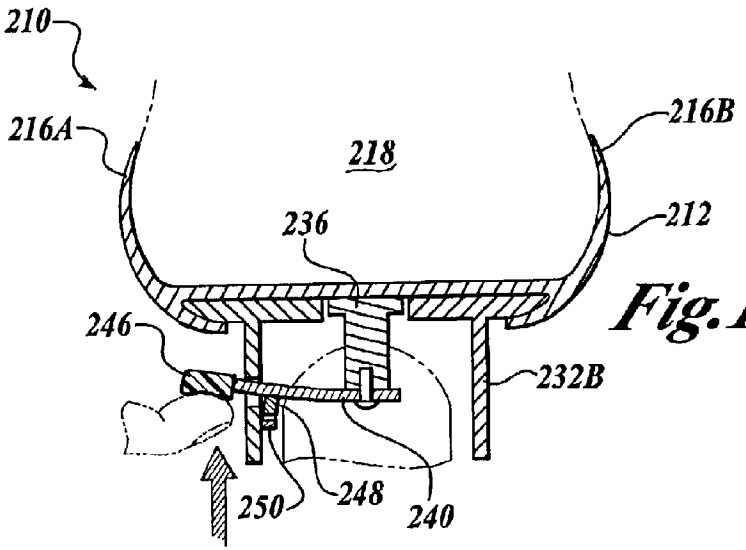
FIG. 10 illustrates a front cross-section view of the skate shown in FIG. 9 having a cantilevered elongate member displaced from a detent.

If the rider wishes to change the size of the skate so that the skate may fit a skater with a larger foot, the skater may translate the actuator 34 by depressing the actuator inward with her finger, which is depicted in FIG. 8. As shown in FIG. 8, the actuator 34 is linearly translated in the horizontal plane against the force of the biasing member 118 to disengage the teeth 126A and 126B of the actuator 34 from the detent notches 88A–E of the slot 82. In this position, the toe cup 16 may slide or translate in the longitudinal dimension relative to the heel end of the base (note shown) to increase the size of the cavity formed by the upper so that the upper 12 may receive a larger foot of a skater. The toe cup 16 and actuator 34 travel together during adjustment. In the embodiment shown, this can be easily done by grasping the toe cup with one hand and in one movement, depress the actuator with the thumb and translate the toe cup.

As the toe cup 16 translates to a final or second desired longitudinal position shown in FIG. 8, the boss 102 and elongate rib member 90 slide with the slots 82 and 108, respectively, preventing the toe cup 16 from rotating. Accordingly, the rivet 52 securably coupling the toe cup 16 to the base passes or translates in the slot 104 of the boss 102. Once the toe cup 16 is in a desired longitudinal position relative to the heel end of the base, the actuator 34 may be released by removing the finger of the rider. After the finger of the rider is released, the biasing force of the biasing member 118 linearly translates the actuator 34 outward and meshes the teeth 126A and 126B of the actuator 34 with the detent notches 88A–E of the slot 82, as described above with reference to FIG. 7. The tapered shape of the teeth on the actuator guide the actuator into locking engagement when the actuator is released.

Figure 9:
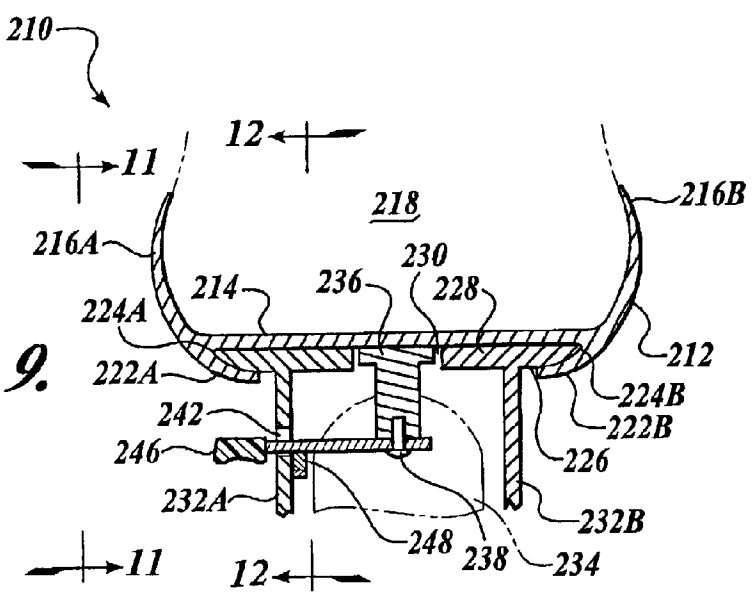
FIG. 9 illustrates a front cross-section of an alternative embodiment of a tool-less size-adjustable in-line skate constructed in accordance with aspects of the present invention.
Figure 11:
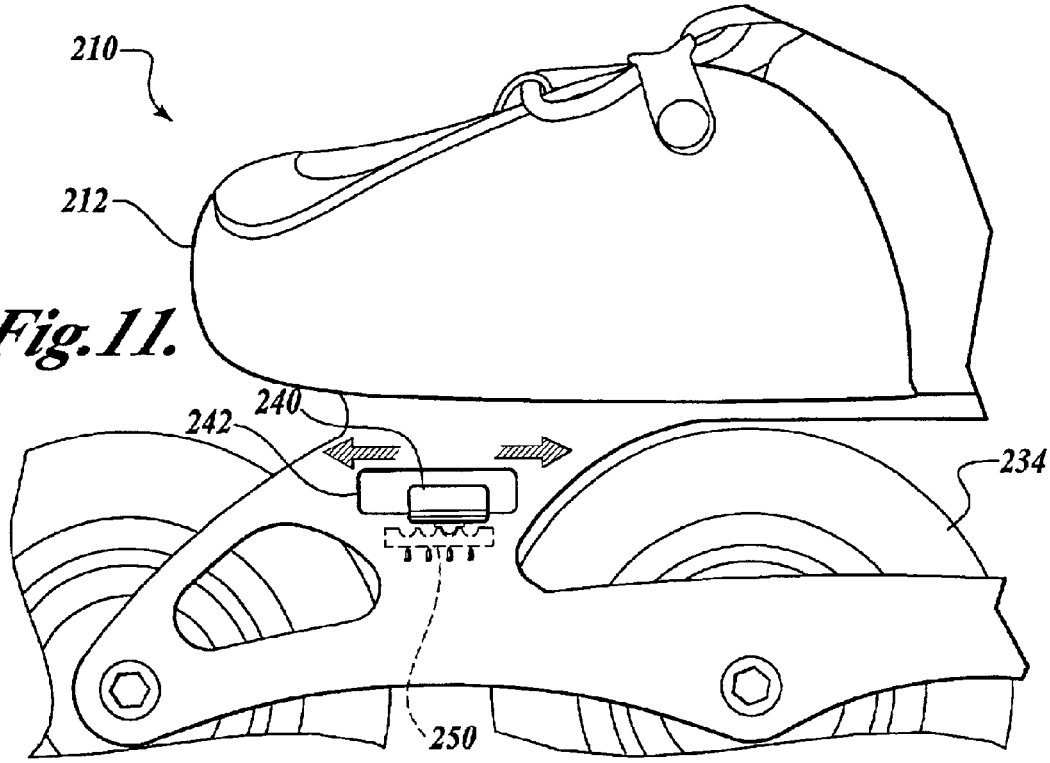
FIG. 11 illustrates a side elevation view of the skate shown in FIG. 9.
Figure 12:
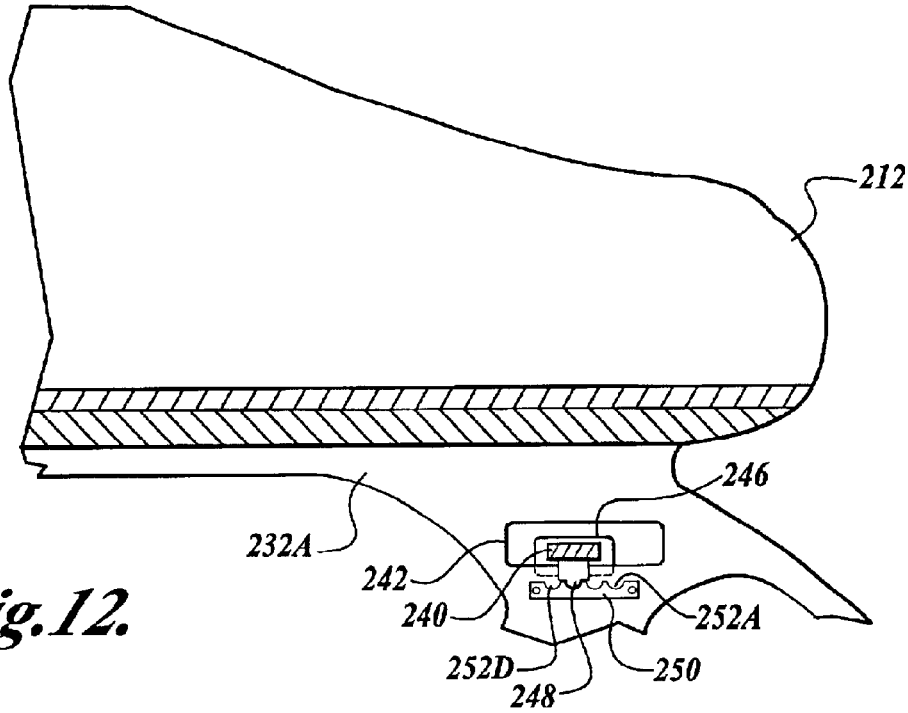
FIG. 12 illustrates an exploded side elevation view of an inside surface of a side wall of the skate shown in FIG. 9.

An alternative embodiment of a tool-less size-adjustable in-line skate constructed in accordance with aspects of the present invention is illustrated in FIGS. 9–12 and will now be described in detail. FIG. 9 illustrates a front cross-section of a skate 210. The skate 210 is constructed similar to skate 10 illustrated in FIGS. 1–8, except for differences that will now be described. The skate 210 includes a toe cup 212 having a bottom wall 214 and upwardly extending side walls 216A and 216B which define a cavity 218. Downwardly descending from the bottom wall 214 of the toe cup 212 are two flanges 222A and 222B which define slots 224A and 224B for receiving a base 226. The base 226 includes a top plate 228 which is slideably coupled with the slots 224A and 224B. The base 226 includes a centrally located, longitudinal dimensioned slot 230 and two downwardly descending side walls 232A and 232B. Journaled between the side walls 232A and 232B are a plurality of ground engaging members such as wheels 234.

The toe cup 212 further includes an elongate member 236 coupled to the bottom surface of the toe cup 212 and extending downward within the slot 230. Cantilevered to the end of the elongate member 236 by a fastener such as a screw 238 is a second elongate member 240 to form an actuator. The elongate member 240 is a resilient member, thus may be deformed and is inherently spring biased to return to its initial position. The other end of the elongate member 240 extends in a substantially horizontal plane through an aperture 242 in side wall 232A and terminates with a knob 246. The elongate member 240 further includes an engagement member 248 coupled to the elongate member 240 and extending in a substantially vertical plane. Mounted to the inner surface of side wall 232A, below the aperture 242, is a second engagement member 250 having a plurality of vertically arranged detent notches 252A–252D.

Figure 15:
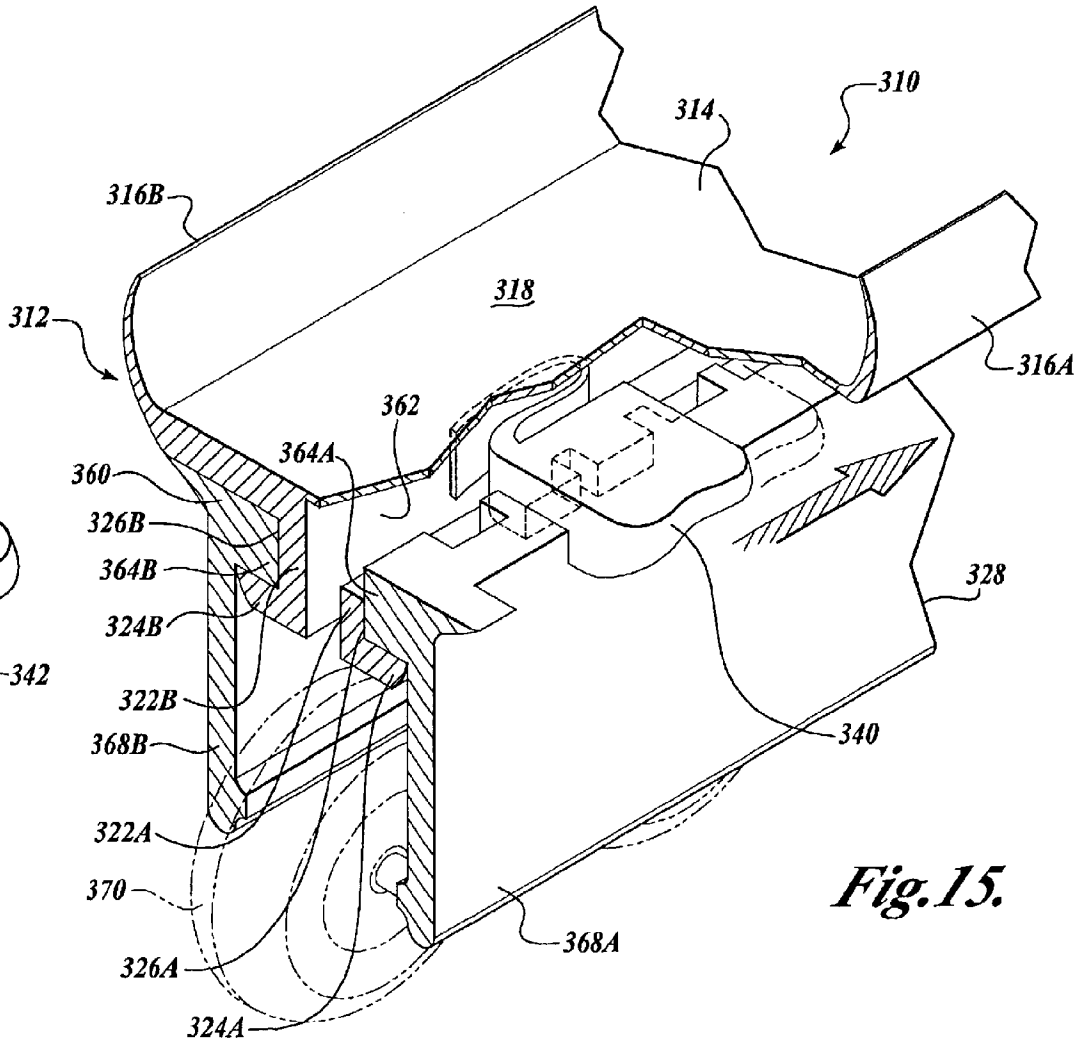
FIG. 15 illustrates an isometric cut-away view of yet another embodiment of a tool-less size-adjustable in-line skate utilizing the actuator shown in FIG. 14.
Figure 14:
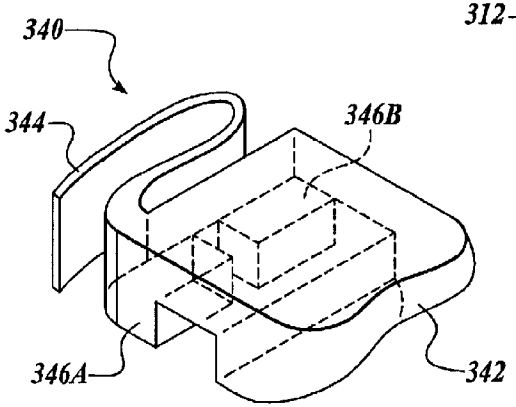
FIG. 14 illustrates an isometric view of an actuator for yet another embodiment of a tool-less size-adjustable in-line skate constructed in accordance with aspects of the present invention.

Another alternative embodiment of a tool-less size-adjustable in-line skate constructed in accordance with aspects of the present invention is illustrated in FIGS. 14 and 15 and will now be described in detail. FIG. 15 illustrates an isometric cut-away view of a skate 310. The skate 310 is constructed similar to skate 10 illustrated in FIGS. 1–8, except for differences that will now be described. The skate 310 includes a toe cup 312 having a bottom wall 314 and upwardly extending side walls 316A and 316B which define a cavity 318. Downwardly descending from the bottom wall 314 of the toe cup 212 are two side walls 322A and 322B. Extending in an outward direction, transverse from the end of side walls 322A and 322B are flanges 324A and 324B which define slots 326A and 326B for receiving a base 328. Mounted in a slot (not shown) through side wall 322A in a slideable fashion is an actuator 340.

As best shown in FIG. 14, the actuator 340 is of a unitary construction substantially rectangular in shape. One end of the actuator is contoured to define an engagement face 342 for engagement with the thumb or forefinger of a rider. At the opposite end of the actuator is an integrally formed biasing member 344, which abuts against the inner surface of side wall 322 B (FIG. 15). The upper surface of the actuator 340 is substantially flat to slideably seat within the slot in the toe cup 312 (FIG. 15). Integrally formed in the bottom surface of the actuator 340 are engagement members or teeth 346A and 346B. In one embodiment, the teeth are rectangular in geometry and extend in the direction of the face 342. While shown in FIG. 14 as rectangular in shape, the teeth 346A and 346B may be of any suitable size and geometry without departing from the scope of the present invention. When slideably received in the slot of side wall 322A, the teeth 346A and 346B are disposed substantially horizontal and outwardly facing. The biasing member 344 biases the actuator 34 outward toward the side wall 322A of the toe cup so that the teeth 346A and 346B mesh with detent notches 350 in the base 328.

Referring now to FIG. 15, the base 328 includes a top plate 360 having a longitudinal slot 362 therein which defines rails 364A and 364B. The slot 362 is centrally located for receiving the side walls 322A and 322B of the toe cup 312. The rails 364A and 364B slide within the slots 326A and 326B of the toe cup 312 to slideably coupled the toe cup to the base 328. Formed in the inner surface of the slot 362 are a plurality of detent notches 350, which mesh with teeth 346A and 346B of the actuator to fix the toe cup in a stationary position. Downwardly descending from the top plate 360 are side walls 368A and 368B. Journaled between the side walls 368A and 368B are a plurality of ground engaging members such as wheels 370.

While the exemplary embodiments of the size adjustment mechanism described above and illustrated herein has been shown to utilize teeth and detent notches selectively secure the toe cup to the base, it should be readily evident that the size adjustment mechanism may utilize other detent mechanisms, such as a biased plunger meshing with grooves, without departing from the scope of the present invention.

Additionally, while the exemplary embodiments of the size adjustment mechanism described above and illustrated herein has been shown to adjust the toe cup in a longitudinal direction, it should be readily evident that the size adjustment mechanism may be utilize to adjust the toe cup in the lateral direction to accommodate a wider foot or to expand the volume of the upper without departing from the scope of the present invention.

The embodiments above have been illustrated and described in terms of an in-line roller skate. It should be understood that the size adjustment mechanism may also be utilized with other types of roller skates and with ice skates. Additionally, the size adjustment mechanism may be adapted for use with other types of athletic boots for sports.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A size-adjustable skate having at least one ground engaging member comprising:

a base having a top surface for supporting a skater's foot, said top surface of said base including a plurality of detents;

an upper for receiving a skater's foot;

a support structure for supporting said upper, said support structure including a toe member having top and bottom surfaces, said toe member slideably coupled to said base such that said bottom surface of said toe member opposes said top surface of said base, said toe member slideably adjustable between a plurality of positions along said top surface of said base; and an actuator coupled to said toe member, said actuator operable to move in a plane substantially coplanar with said top surface of said base;

wherein said toe member is selectively movable on said base to adjust the shoe size of said skate by operation of a size adjustment mechanism formed by said detents of said base and a portion of said actuator.

2. The skate of claim 1, wherein said actuator is manually operated.

3. A size-adjustable skate having at least one ground engaging member comprising:

a base having a top surface for supporting a skater's foot;

a plurality of detents disposed on said top surface of said base;

an upper for receiving a skater's foot;

a support structure for supporting said upper, said support structure including a toe member having top and bottom surfaces, said toe member slideably coupled to said base such that said bottom surface of said toe member opposes said top surface of said base, said toe member slideably adjustable between a plurality of positions on said base; and an actuator coupled to said toe member, wherein said actuator selectively translates in a substantially linear manner to engage at least one of said plurality of detents;

wherein said toe member is selectively movable on said base to adjust the shoe size of said skate.

4. The skate of claim 3, wherein said toe member is slideably adjustable between a plurality of longitudinal positions on said base.

5. The skate of claim 3, wherein said toe member is slideably coupled to said base by a fastener.

6. The skate of claim 5, wherein said fastener is a permanent fastener.

7. The skate of claim 3, wherein said plurality of detents are horizontally disposed in said top surface of said base.

8. The skate of claim 3, wherein said toe member includes a bottom wall in slideable relation with said base, said bottom wall having a slot extending therethrough, said actuator slideably coupled within said slot.

9. The skate of claim 3, wherein said actuator includes horizontally oriented teeth, said teeth engage and disengage with said detents of said base.

10. The skate of claim 3, wherein said actuator is manually operated.

11. A size-adjustable skate having at least one ground engaging member comprising:

a base having a top surface for supporting a skater's foot and a bottom surface, said base defining a plurality of detents, wherein said top surface of said base includes a slot disposed in the longitudinal dimension of the skate, said detents being formed in a side of said slot;

an upper for receiving a skater's foot, said upper defining a toe portion, a heel portion, and diametrically opposed side wall portions, said upper coupled to said base;

a support structure for supporting said upper, said support structure including a toe member having top and bottom surfaces, said toe member coupled to said toe portion of said upper and slideably coupled to said base by a fastener, said toe member slideably adjustable between a plurality of positions on said base; and an actuator coupled to said toe member, said actuator selectively engageable with one of said plurality of detents;

wherein said toe member is selectively movable on said base to adjust the shoe size of said skate.

12. The skate of claim 11, wherein a bottom surface of said toe member includes a downwardly descending boss, said boss being disposed longitudinally and mates with said slot.

13. The skate of claim 12, wherein said boss includes a slot, said fastener translatable within said slot of said boss.

14. A size-adjustable skate having at least one ground engaging member comprising:

a base having a top surface for supporting a skater's foot;

a plurality of detents disposed on said top surface of said base;

an upper for receiving a skater's foot;

a support structure for supporting said upper, said support structure including a toe member having top and bottom surfaces, said toe member slideably coupled to said base such that said bottom surface of said toe member opposes said top surface of said base, said toe member slideably adjustable between a plurality of positions on said base; and an actuator coupled to said toe member, wherein said actuator selectively translates in a substantially linear manner to engage at least one of said plurality of detents;

wherein said toe member is selectively movable on said base to adjust the shoe size of said skate; and wherein said top surface of said base includes an elongate rib member and said bottom surface of said toe member includes a slot of corresponding shape with respect to said elongate rib member, said elongate rib member and said slot mate to form a guide mechanism for preventing the rotation of said toe member when said toe member slideably adjusts relative to said base.

15. A size-adjustable skate comprising:

a base having a top surface for supporting a skater's foot and a bottom surface;

a plurality of detents disposed on said top surface of said base;

a frame coupled to said bottom surface of said base, said frame having a bottom end to which at least one ground engaging member is attached;

an upper for receiving a skater's foot, said upper including a heel portion;

a support structure for supporting said upper, said support structure including a toe member slideably coupled to said base such that a bottom surface of said toe member faces said top surface of said base, said toe member slideably adjustable between a plurality of longitudinal positions; and an actuator operably coupled to said toe member, and translatable with said toe member, that selectively engages one or more of said plurality of detents of said base;

said actuator operable to fix said toe member to said base in a desired longitudinal position relative to said heel portion and operable to adjust said toe member so that said toe member slides longitudinally to achieve a second desired longitudinal position relative to said heel portion, wherein said actuator is moved generally horizontally to permit said toe member to slide longitudinally to achieve a second longitudinal position.

16. The skate of claim 15, wherein said toe member is slideably coupled to said base by a fastener.

17. The skate of claim 15, wherein said plurality of detents are horizontally disposed within said base.

18. A size-adjustable skate comprising:

a base having a top surface for supporting a skate's foot and a bottom surface;

a frame coupled to said bottom surface of said base, said frame having a bottom end to which at least one ground engaging member is attached;

an upper for receiving a skater's foot;

a support structure for supporting said upper, said support structure including a toe member slideably coupled to and supported by said top surface of said base, said toe member selectively slideably adjustable between a plurality of longitudinal positions; and an actuator operably coupled to said toe member and slideable with said toe member, said actuator selectively movable in a substantially linear manner to engage with a portion of said top surface of said base to fix said toe member in a desired longitudinal position, and is movable in a substantially linear manner to disengage from a portion of said top surface of said base to allow said toe member to slideably translate on said base to a second desired longitudinal position.

19. The skate of claim 18, wherein said toe member is slidably coupled to said base by a fastener.

20. The skate of claim 18, where said actuator is biased to engage with a position of said base to fix said to member in a desired longitudinal position.

21. The skate of claim 18, wherein said toe member is a toe cup.

22. A size-adjustable skate comprising:

a base having a top surface for supporting a skater's foot and a bottom surface;

a plurality of detents disposed on said top surface of said base;

a frame coupled to said bottom surface of said base, said frame having a bottom end to which at least one ground engaging member is attached;

an upper for receiving a skater's foot and coupled to said base, said upper defining a toe portion, a heel portion, and diametrically opposed side wall portions, said side wall portions defining a vamp opening extending upwardly from said toe portion of said upper;

said upper further including a tongue disposed within said upper and having a lower end fastened to said toe portion of said upper and extending upwardly along said vamp opening, and an elastic web fastened to said upper on said diametrically opposed side wall portions and spanning across at least a portion of said vamp opening over the instep of the skater's foot, compressing said tongue under said elastic web;

a support structure for supporting said upper, said support structure including a toe member having top and bottom surfaces, said toe member slideably coupled to said base such that said bottom surface of said toe member faces said top surface of said base, said toe member slideably adjustable between a plurality of positions on said base; and an actuator coupled to said toe member, said actuator operable to move in a plane substantially coplanar with said top surface of said base and to selectively engage one of said plurality of detents;

wherein said toe member is selectively movable on said base to adjust the shoe size of said skate.

23. A size-adjustable skate having at least one ground engaging member for traversing a traversable surface, comprising:

a base having a top surface for supporting a skater's foot, said top surface of said base defining a plurality of detents;

an upper for receiving a skater's foot;

a support structure for supporting said upper, said support structure including a toe member having top and bottom surfaces, said toe member slideably adjustable between a plurality of positions on said base; and an actuator coupled to said toe member, said actuator movable in a generally horizontal manner to selectively engage one or more of said plurality of detents;

wherein said toe member is selectively movable on said base to adjust the shoe size of said skate.

24. The skate of claim 23, wherein said top surface of said base defines a plane substantially parallel to the traversable surface while the skate is in use.

25. A size-adjustable skate having at least one ground engaging member, comprising:

a base having a top surface for supporting a skater's foot;

an upper for receiving a skater's foot;

a support structure for supporting said upper, said support structure including a toe member having top and bottom surfaces, said toe member slideably coupled to said base such that said bottom surface of said toe member opposes said top surface of said base, said toe member being slideably adjustable between a plurality of fixed positions on said base; and an adjustment mechanism that selectively adjusts the position of said toe member between said plurality of fixed positions on said base, wherein said adjustment mechanism includes a manually operated actuator movable in a substantially linear manner between a locked position in which said toe member is fixedly secured to said base in one of said fixed positions and an unlocked position in which said toe member is permitted to slide along said base, wherein a portion of said actuator is positioned in-between said adjoining surfaces of said toe member and said base.

26. A size-adjustable skate having at least one ground engaging member, comprising:

a base having a top surface for supporting a skater's foot;

an upper for receiving a skater's foot;

a support structure for supporting said upper, said support structure including a toe member having top and bottom surfaces, said toe member slideably coupled to said base such that said bottom surface of said toe member opposes said top surface of said base, said toe member slideably adjustable between a plurality of fixed positions on said base; and an adjustment mechanism that selectively adjusts the position of said toe member between said plurality of fixed positions on said base, wherein said adjustment mechanism includes a plurality of detents and an actuator movable in a substantially linear manner between a locked position in which said actuator engages at least one of said plurality of detents to fixedly secure said toe member in one of said fixed positions and an unlocked position in which said actuator disengages at least one of said plurality of detents to permit movement of said toe member along said base, wherein said adjustment mechanism is positioned in-between the adjoining surfaces of said bottom surface of said toe member and said top surface of said base.

27. A size-adjustable skate having at least one ground engaging member comprising:

a base having a top surface for supporting a skater's foot;

an upper for receiving a skater's foot;

a support structure for supporting said upper, said support structure including a toe member having top and bottom surfaces, said toe member slideably coupled to said base such that said bottom surface of said toe member opposes said top surface of said base, said toe member being slideably adjustable between a plurality of fixed positions on said base;

a plurality of detents disposed on one of said top surface of said base or said bottom surface of said toe member; and an actuator selectively movable in a substantially linear manner between a locked position in which said actuator engages at least one of said plurality of detents to fixedly secure said toe member in one of said fixed positions and an unlocked position in which said actuator disengages said at least one of said plurality of detents to permit movement of said toe member along said base.

* * * * *